US005916041A

United States Patent [19]

Antonious

[11] Patent Number: 5,916,041

[45] **Date of Patent: *Jun. 29, 1999**

[54] GOLF CLUB HEAD WITH OUTER PERIPHERAL WEIGHTING SYSTEM

[76] Inventor: Anthony J. Antonious, 7738 Calle Facil, Sarasota, Fla. 34238

[ * ] Notice: This patent is subject to a terminal disclaimer.

[21] Appl. No.: 08/987,107

[22] Filed: Dec. 8, 1997

Related U.S. Application Data

[63] Continuation-in-part of application No. 08/914,246, Aug. 19, 1997, abandoned, which is a continuation-in-part of application No. 08/599,405, Nov. 22, 1995, Pat. No. 5,658,206.

[51] Int. Cl.[6] ..... A63B 53/04

[52] U.S. Cl. ..... 473/328; 473/349; 473/350

[58] Field of Search ..... 473/328, 349, 473/350, 324, 290, 291, 344; D21/220

[56] References Cited

U.S. PATENT DOCUMENTS

| | | | |
|---|---|---|---|
| 4,754,969 | 7/1988 | Kobayashi . | |
| 4,869,507 | 9/1989 | Sahm . | |
| 5,658,206 | 8/1997 | Antonious | 473/328 |
| 5,766,095 | 6/1998 | Antonious | 473/345 |

*Primary Examiner*—Sebastiano Passaniti
*Attorney, Agent, or Firm*—Aquilino & Welsh

[57] ABSTRACT

An iron type golf club head having a secondary outermost perimeter weight system including a weight member extending outwardly from and overlaying the primary perimeter surfaces of the club head, which further displaces the mass of the club head from the center of percussion. The secondary outer weight member extends from the primary perimeter surfaces of the club head body onto at least a portion of the hosel forming a unitized interconnection between the hosel and the club head body.

10 Claims, 7 Drawing Sheets

FIG. 1
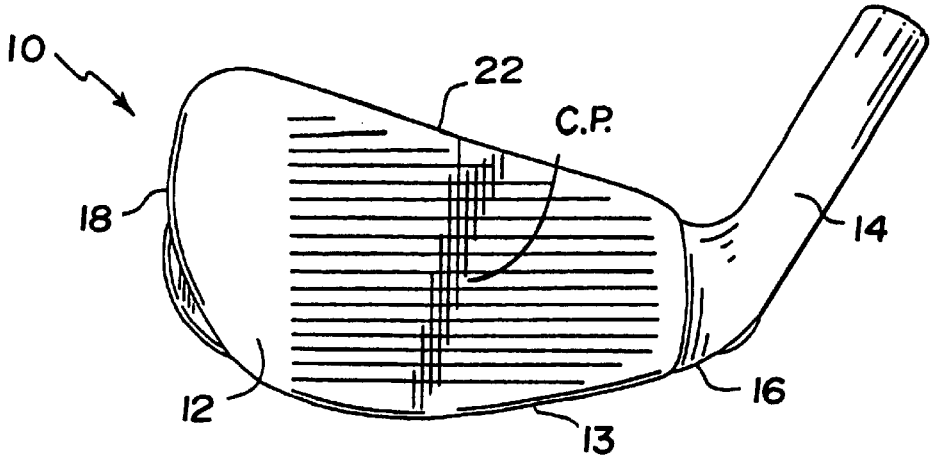
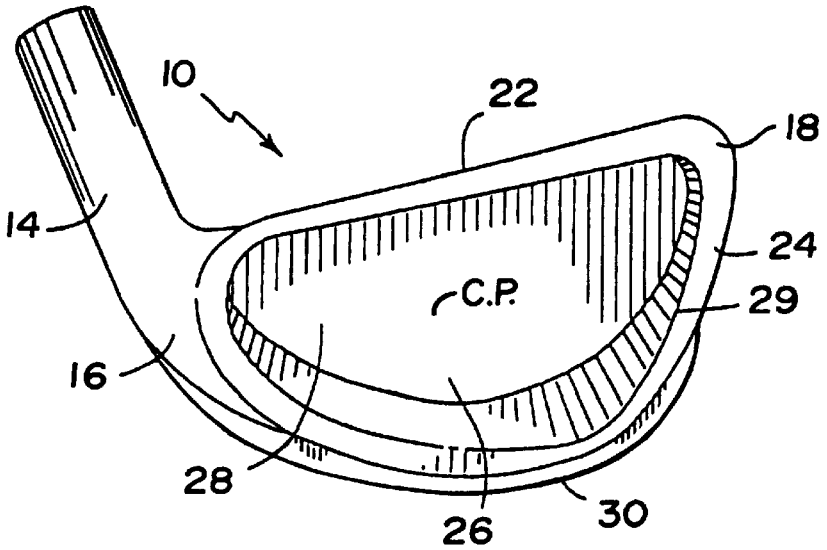
FIG. 2
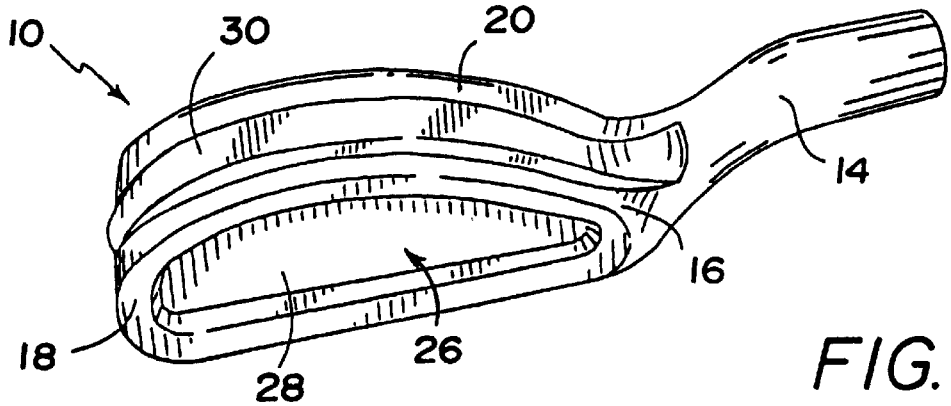
FIG. 3

FIG. 4
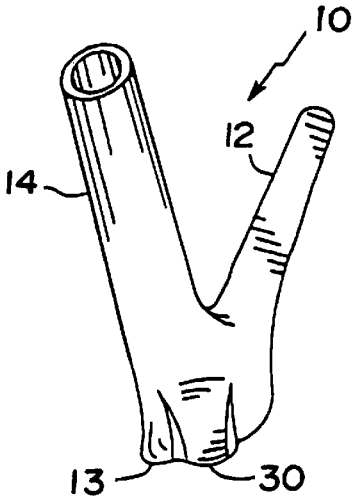
FIG. 5
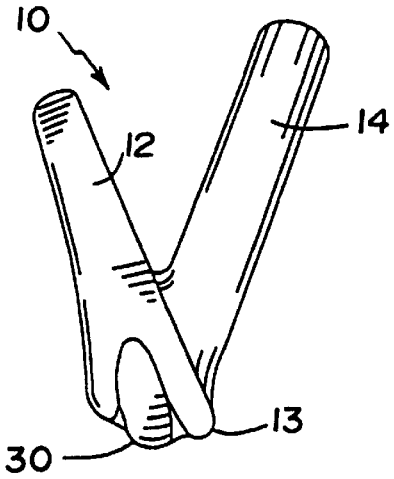
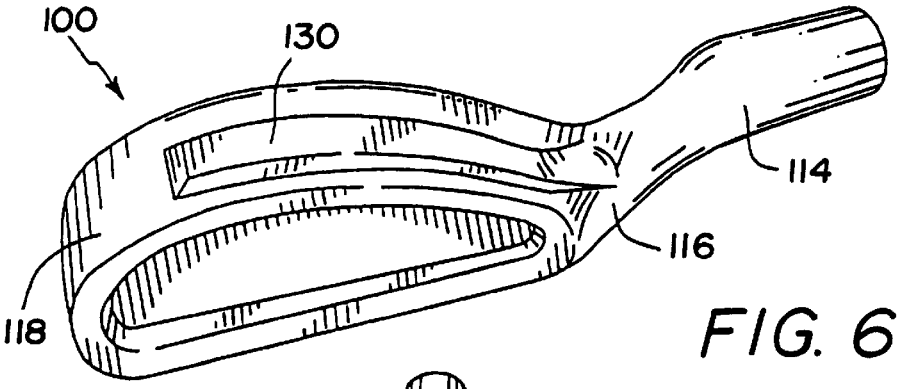
FIG. 6
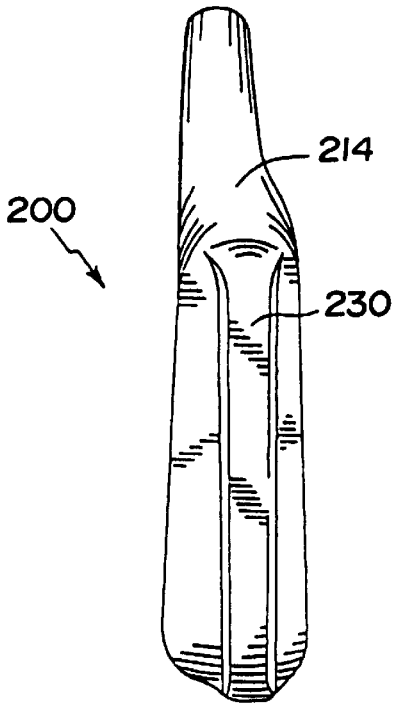
FIG. 7

FIG. 8
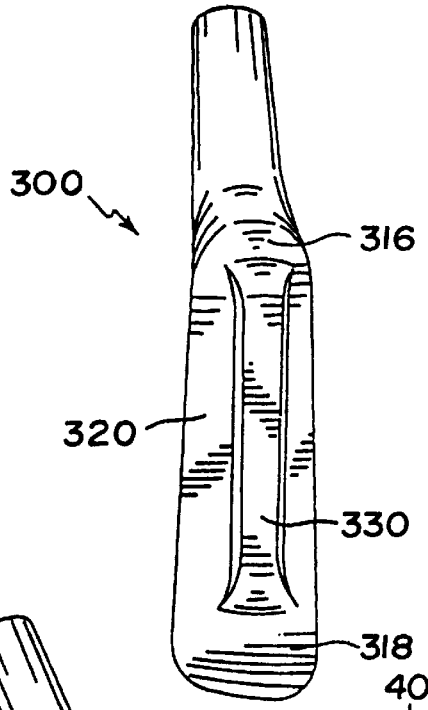
FIG. 9
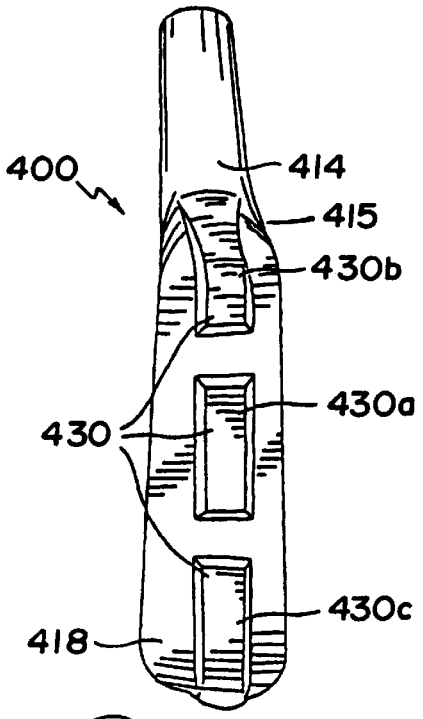
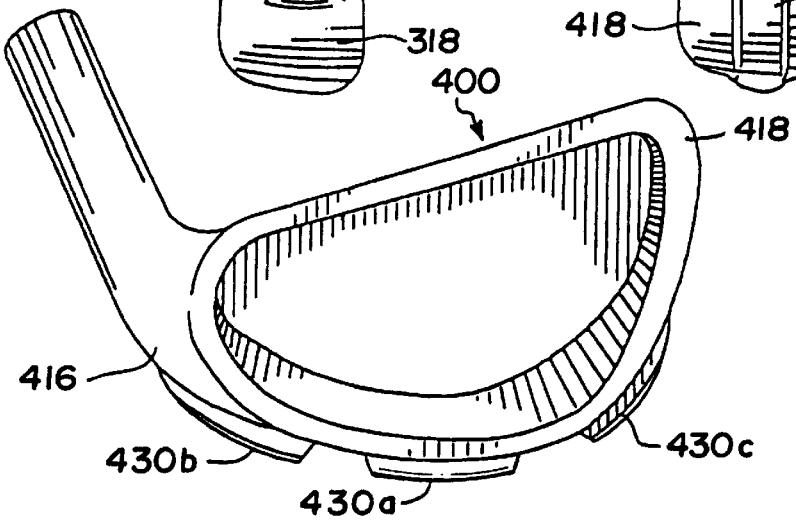
FIG. 10
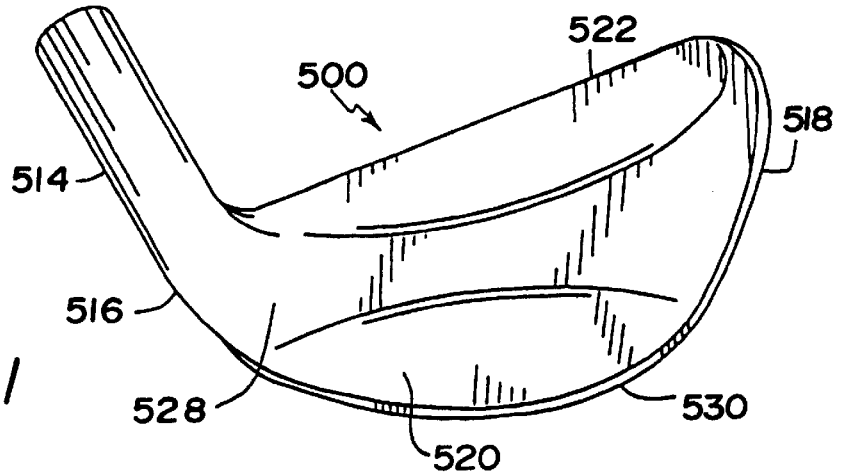
FIG. 11

FIG. 12
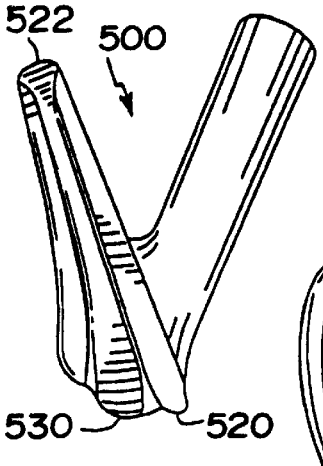
FIG. 13
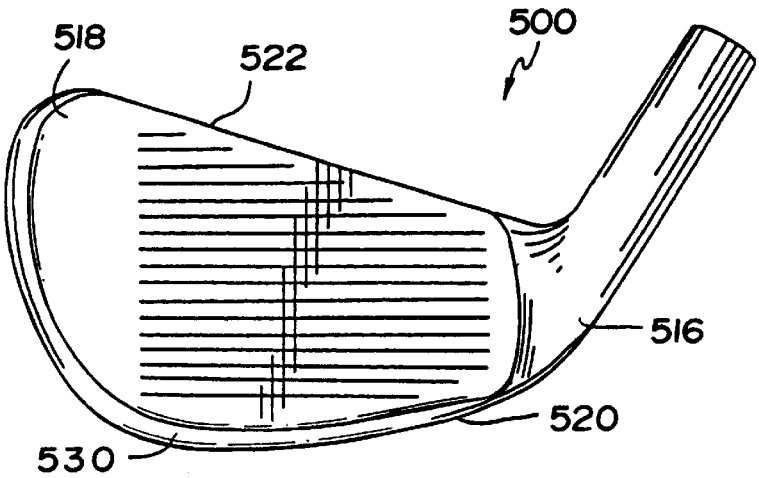
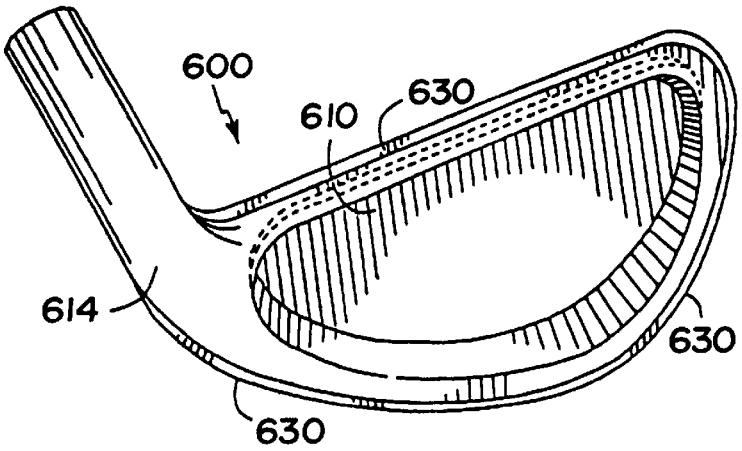
FIG. 14
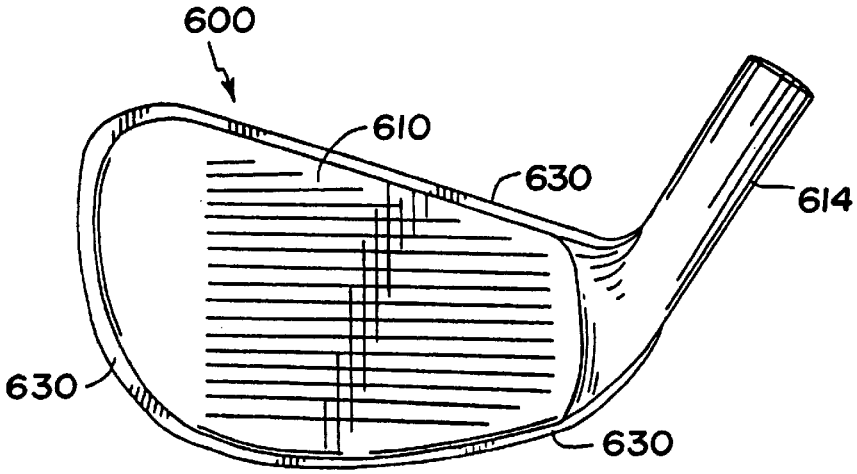
FIG. 15

GOLF CLUB HEAD WITH OUTER PERIPHERAL WEIGHTING SYSTEM

RELATED APPLICATIONS

This application is a continuation-in-part of prior application Ser. No. 08/914,246, filed Aug. 19, 1997 now abandoned, by A. J. Antonious, which in turn is a Continuation-in-part of Ser. No. 08/599,405, filed Nov. 22, 1995, now U.S. Pat. No. 5,658,206 for GOLF CLUB WITH OUTER PERIPHERAL WEIGHT CONFIGURATION

BACKGROUND AND SUMMARY OF THE INVENTION

The present invention relates to an iron-type golf club head and in particular to an iron-type golf club head having an improved secondary outer perimeter weight configuration.

It is well known that iron-type golf club heads that have outer perimeter weighting tend to be more forgiving when shots are miss hit, thereby imparting more energy to the ball struck off of the center of percussion. There has been a trend in the golf club industry to provide larger golf club heads in order to further extend the peripheral weight to achieve peripheral weighting characteristics.

The present invention relates to an iron-type golf club head having a secondary outermost peripheral weight configuration in the form of an overlaying weight member extending at least part way around and outwardly from the primary perimeter weight of the club head. The secondary outer peripheral weight member locates more additional mass outwardly from the center of percussion to the secondary outermost periphery while eliminating the need for actually enlarging the overall profile of a standard size club face. The secondary outer peripheral member may extend from the lower heel area across the sole surface, up the toe portion and across the top ridge surface, thereby defining a more effective, precision weight distribution system around the secondary outer periphery of the club head.

The secondary outer peripheral weight configuration, which in this preferred embodiment, practically surrounds the entire hitting area of the club face, overlays and cooperates with the primary perimeter mass of the club head creating a unitized secondary outer peripheral weight configuration heretofore unknown in the golf club art. This unique arrangement of weight provides a most effective and precise distribution of mass around the clubhead thereby permitting an optimum transfer of energy to the entire hitting area of the club face while substantially enlarging the sweet spot and making it greater than on a comparably sized club face. The unitized secondary outer peripheral weight configuration provides greater club head control and increased stability at impact, regardless of where the ball contact is made on the club face, resulting in less torque and turning of the club head during the execution of the shot. The elongated longitudinal shape of the secondary outer peripheral weight member, on the sole portion of the club head, also acts as a deflector or skimmer, allowing the club head to glide smoothly over the turf when making ground contact, rather than bouncing causing a thin shot or embedding the leading edge of the clubface into the ground. This bouncing or embedding results in decreased club head speed and possible adverse or painful sensations to the golfers hands which can be caused by the shock and vibrations that occur when ground contact occurs.

In a preferred embodiment of the present invention, a conventional golf club head is provided with a keel-type, outermost, longitudinal, secondary peripheral weight member located approximately mid-way between the front and rear of the club head, and around the entire primary peripheral edge of the club head body up to and including at least a portion of the hosel. The outermost secondary weight member may be rectangular, circular, semi-circular or any other geometrical shape providing minimum aerodynamic and ground contact drag. The secondary outer peripheral weight configuration transitions into the hosel providing a much more rigid, unitized connection between the hosel and the club body to further solidify the connection between the club head body and the hosel thereby allowing maximum transfer of power generated from the hands and arms of the player, through the shaft hosel and into the club head itself.

In another preferred embodiment, the secondary outer peripheral weight member may extend around the entire outer primary periphery of the club head including the top ridge area.

Alternately, the secondary outer peripheral weight member may extend part way along the sole of the club head as well as extending part way from the sole surface into the heel and toe areas of the club head. The secondary, outermost peripheral weight may be positioned close to the front or close to the rear surface of the club head, depending upon the desired performance characteristics of the individual club head.

In other embodiments, the secondary outer peripheral weight configuration is formed on only a portion of the sole. Other embodiments use a secondary outermost peripheral weight which extends part way along the toe portion and heel or hosel portions of the club head.

It will be appreciated that the provision of the secondary outer peripheral weight configuration may be equally applicable to golf club heads having a flat or muscle back configuration.

Among the objects of the present invention are the provision of an iron-type golf club head having improved weight characteristics.

Another object is the provision of a iron-type golf club head having an increased secondary outermost peripheral weight structure which allows maximum transfer of energy to a golf ball, particularly when it is struck off of the center of percussion.

Still another object of the present invention is the provision of an outermost peripheral weight configuration formed on the sole surface of the golf club head which acts to minimize bounce and to stabilize the club head and prevent or minimize it from being embedded deeply into the turf during the execution of the a golf shot.

Yet another object of the present invention is the provision of a golf club head having a secondary outermost peripheral weight system providing a most effective and precise distribution of mass thereby permitting an optimum transfer of energy to the entire hitting area of the club face while substantially enlarging the sweet spot and making it greater than on a comparably sized club face.

These and other objects of the present invention will become apparent with reference to the following specification and drawings.

BRIEF DESCRIPTION OF THE DRAWINGS

FIG. 1 is a front elevational view of a first embodiment of a golf club head of the present invention.

FIG. 2 is a rear elevational view of the club head of FIG. 1.

FIG. 3 is a bottom view of the club head of FIG. 1.

FIG. 4 is a heel end elevational view of the club head of FIG. 1.

FIG. 5 is a toe end elevational view of the club head of FIG. 1.

FIG. 6 is a bottom view of a second embodiment of a golf club head of the present invention.

FIG. 7 is a bottom view of a third embodiment of a golf club head of the present invention.

FIG. 8 is a bottom view of a forth embodiment of a golf club head of the present invention.

FIG. 9 is a bottom view of a fifth embodiment of a golf club head of the present invention.

FIG. 10 is a rear elevational view of the golf club head of FIG. 9.

FIG. 11 is a rear elevational view of a sixth embodiment of a golf club head of the present invention.

FIG. 12 is an end elevational view of the golf club head of FIG. 11.

FIG. 13 is a front elevational view of the golf club head of FIG. 11.

FIG. 14 is a rear elevational view of a seventh embodiment of a golf club head of the present invention.

FIG. 15 is a front elevational view of the golf club head of FIG. 14.

DESCRIPTION OF THE PREFERRED EMBODIMENTS

Figure 16:
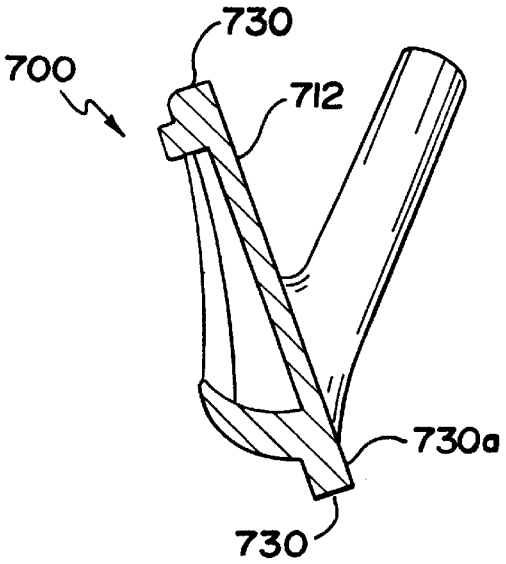
FIG. 16 is a sectional end view of an eighth embodiment of a golf club head of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

FIGS. 1–5 show a first embodiment of an iron type golf club head 10 having a ball striking face 12 with a loft angle of at least 10 degrees and a leading edge 13, a hosel 14, heel 16, toe 18, bottom sole 20, top ridge 22, a primary perimeter weight configuration 24 forming a rear cavity 26, and a rear surface 28 having a trailing edge 29. In this embodiment, a secondary outer peripheral, elongated longitudinal weight member 30 is shown formed on the bottom sole 20 of the club head 10 extending from the heel 16 to the toe 18 and connecting with and smoothly transitioning into the hosel 14. The secondary outer peripheral weight member 30 transfers the overall mass toward the outermost periphery of the club head 10 further removed from the center of percussion, c.p. The weight member 30 is positioned generally parallel to and between the leading edge 13 and trailing edge 29. In this embodiment, a portion of the weight of the club head 10 is shifted toward the lower portion of the club head 10 allowing a player to hit a golf ball higher because of the increased weight at the lower areas of the club head. Furthermore, the secondary outer peripheral weight member 30 engages the turf during the execution of a golf shot preventing the club from digging into the turf during the execution of a golf swing, which could result in a loss of power and possible injury to the hands of the player due to the impact and vibration forces. In this particular embodiment, the secondary outer peripheral weight member 30 is positioned along the middle of the bottom sole, between the striking face 12 and the rear surface 28 of the club head 10. In the toe area, the secondary outer peripheral weight member 30 extends upwardly and smoothly transitions into the toe 18 of the club head.

FIG. 6 shows a second embodiment of a golf-club head 100 having the same configuration and characteristics as the embodiment described with respect to FIGS. 1–5 hereinabove, except that the secondary outer peripheral weight member 130 extends from the heel 116 to a point adjacent the toe 118 of the club head 100 and does not extend from the bottom surface 120 onto the toe 118. In this embodiment, the secondary outer peripheral weight member 130 preferably is spaced from the toe portion of the club head 10 and extends slightly upwardly to form a connection with the hosel 114.

FIG. 7 shows a third embodiment of club head 200 in which a secondary outer peripheral weight member 230 extends to or into the toe 218 and does not extend onto the heel 216 or hosel 214 of the club head 200. This embodiment otherwise is like that shown in FIGS. 1–5.

FIG. 8 shows a forth embodiment of a club head 300 in which a secondary outer peripheral weight member 330 is confined to the sole or bottom surface 320 of the club head 300. The weight member 330 is centrally positioned along the bottom sole 320 and extends proximate to but spaced from the toe 318 and heel 316 of the club head.

FIGS. 9 and 10 show a fifth embodiment of a club head 400 including a secondary outer peripheral weight member 430 formed in separate sections including a central section 430*a*, a heel section 430*b* and toe section 430*c*. In this embodiment the heel section 430*b* extends into and smoothly transitions into the heel 416 and hosel 414. The toe section 430*c* extends into and smoothly transitions into the toe 418 of the club head 400.

FIGS. 11, 12 and 13 show a sixth embodiment of a golf club head 500 having a flat or muscle back configuration on a rear surface 528 in which a secondary outer peripheral weight member 530 extends all the way from the heel 516, across the bottom surface 520 to the point where the toe 518 intersects with the top ridge 522. In this embodiment, the weight member 530 preferably is connected with and transitions into the hosel 514.

FIGS. 14 and 15 show a seventh embodiment of club head 600 having a secondary outer peripheral weight member 630 extending around and overlaying the entire primary perimeter 624 of the club head 600 except for the point where the hosel 614 connects to the club head body 610. In this embodiment, the weight member 630 preferably transitions into and connects with the hosel 614 at both bottom and top, thereby providing a very solid, unitized connection between the club head body 610 and the hosel 614.

FIG. 16 shows an end sectional view of an eighth embodiment of a golf club head 700 of the present invention wherein a secondary outer peripheral weight member 730 is located adjacent the ball striking face 712 and includes a front surface 730*a* aligned with the ball striking face 712.

Figure 17:
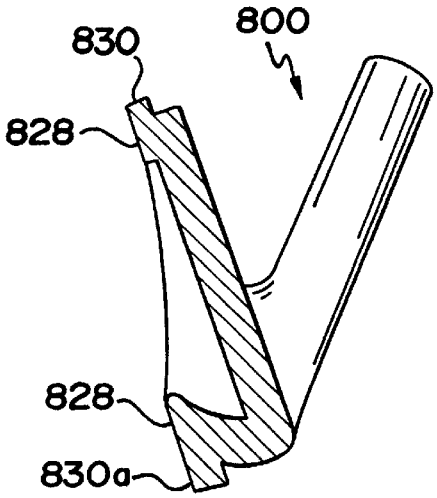
FIG. 17 is a sectional end view of a ninth embodiment of a golf club head of present invention.

FIG. 17 shows an end sectional view of a ninth embodiment of a golf club head 800 of the present invention wherein a secondary outer peripheral weight member 830 is located adjacent a rear surface 828 of the club head 800. Preferably a rear surface 830*a* of the weight member 830 is aligned with the rear surface 828.

Figure 18:
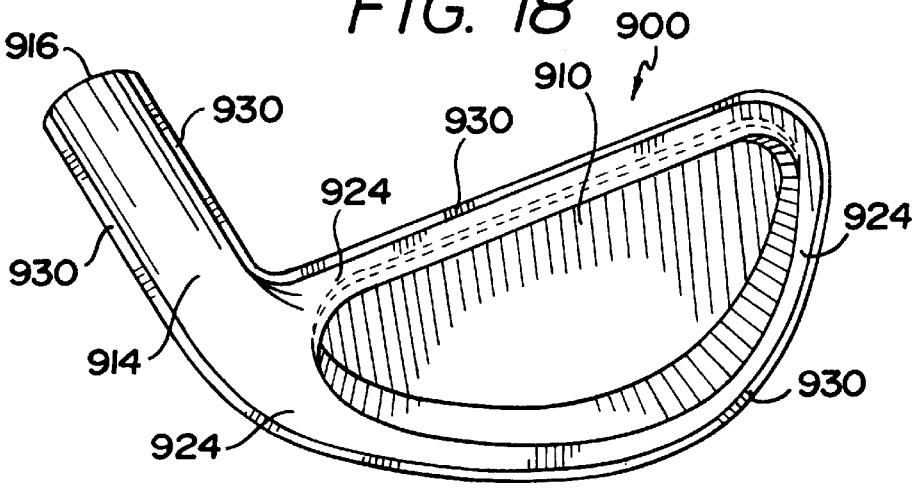
FIG. 18 is a rear elevational view of a tenth embodiment of a golf club head the present invention.
Figure 19:
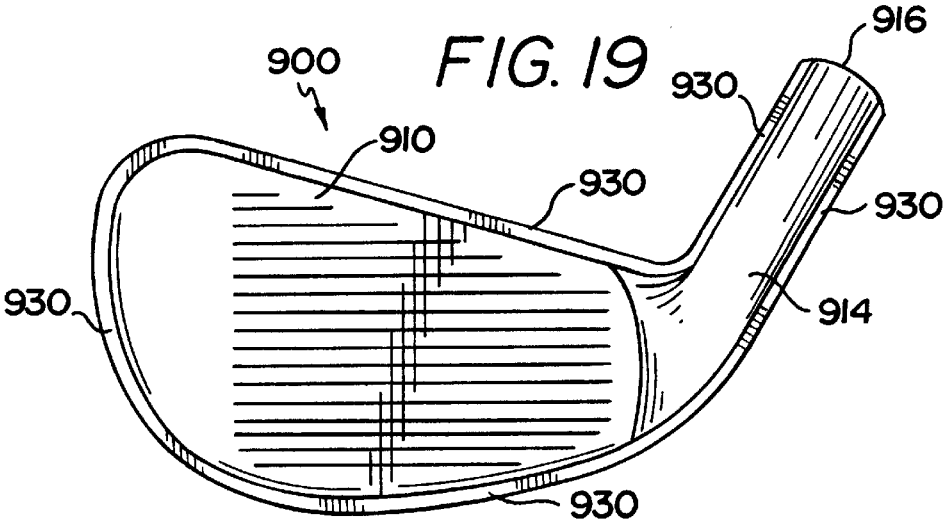
FIG. 19 is a front elevational view of the golf club head of FIG. 18.

FIGS. 18 and 19 show a golf club head 900 including a club head body 910 and a hosel 914 having a secondary outer peripheral weight member 930 which extends around the entire primary perimeter 924 of the club head 900 onto the hosel 914 and terminates at the top edge 916 of the hosel socket. The extension of the secondary outer peripheral weight member 930 along the hosel 914 provides a solid unitized connection between the club head body 910 and the hosel 914 and minimizes torquing and twisting of the club head when executing a full golf shot, even when ball contact is off the center of gravity of the club head 900. This construction permits precision distribution of additional weight overlaying the entire primary perimeter 924 of the club head 900.

Figure 20:
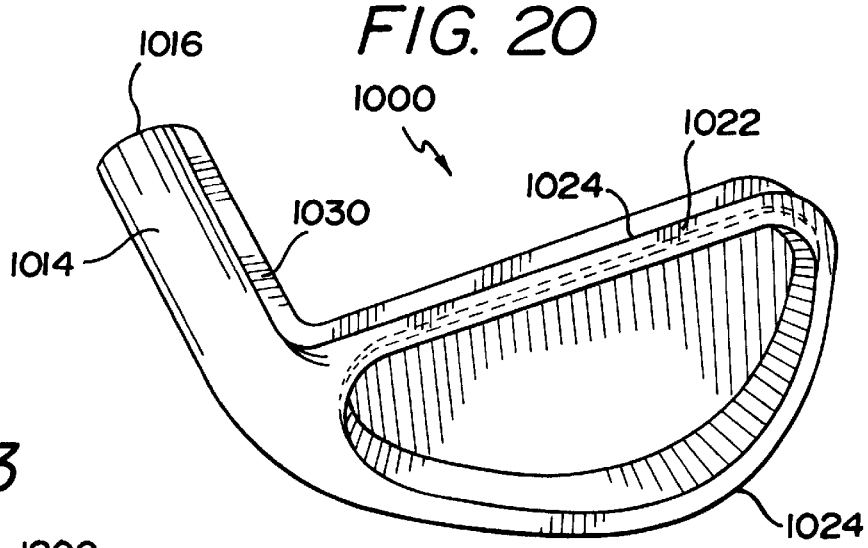
FIG. 20 is a rear elevational view of an eleventh embodiment of a golf club head of the present invention.

FIG. 20 illustrates a tenth embodiment of a golf club head 1000 in accordance with the present invention. In this embodiment, a thicker, larger, more elevated secondary outer peripheral weight member 1030 extends outwardly from the top ridge 1022, overlays the primary perimeter 1024 and gradually transitions onto the hosel 1014 terminating at the top edge 1016 thereof.

Figure 21:
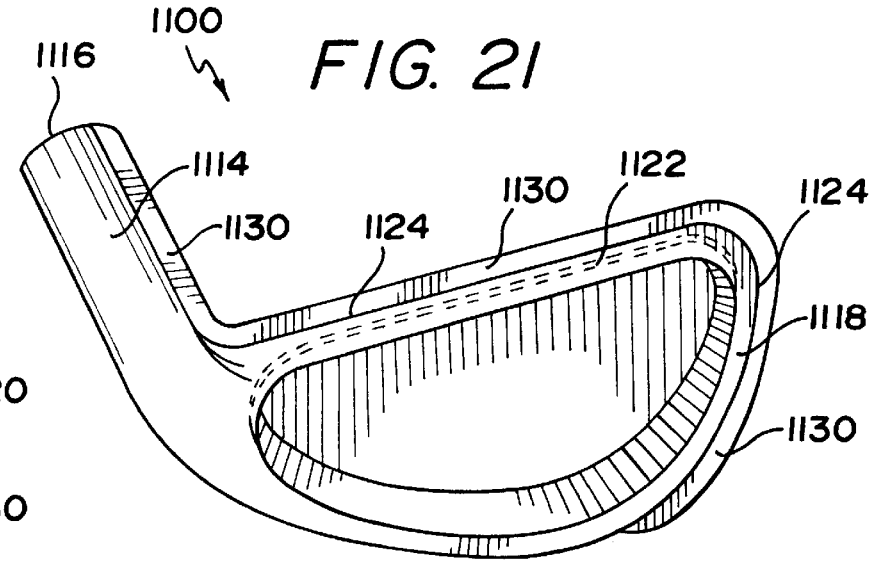
FIG. 21 is a rear elevational view of a twelth embodiment of a golf club head of the present invention.

FIG. 21 shows a twelfth embodiment of a golf club head 1100 in accordance with the present invention including a thicker, more elevated secondary outer peripheral weight 1130 which extends outwardly from the toe 1118, overlays the primary perimeter 1124, continues across the top ridge 1122 and transitions into the hosel 1114 terminating at the top edge 1116.

Figure 23:
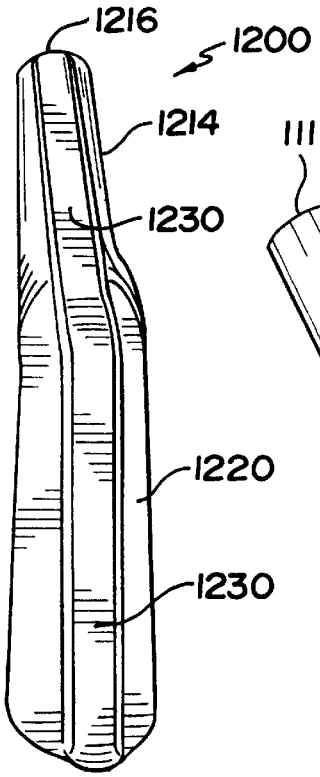
FIG. 23 is a bottom view of the golf club head of FIG. 22.
Figure 22:
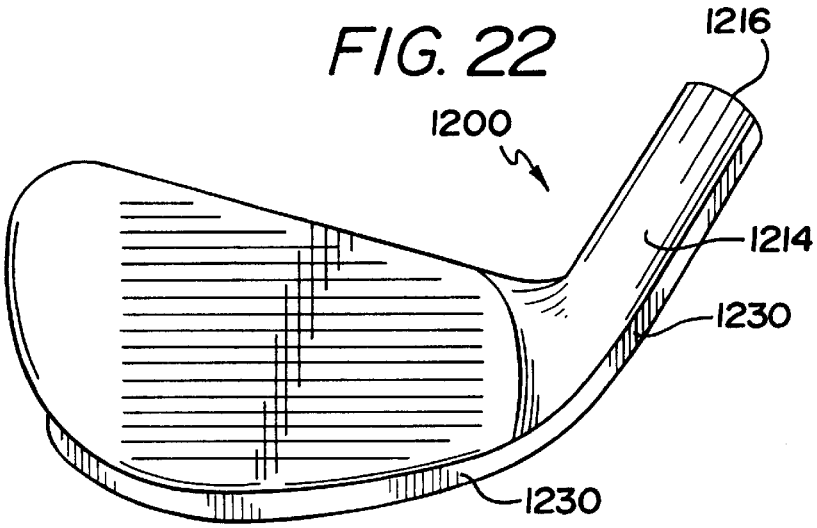
FIG. 22 is a front elevational view of thirteenth embodiment of a golf club head of the present invention.

FIGS. 22 and 23 illustrate a thirteenth embodiment of a golf club head 1200 in accordance in the present invention is illustrated in In this embodiment, a thicker secondary outer peripheral weight member 1230 extends further outwardly than previous embodiments, from the bottom of the club face 1220, gradually transitions upwardly to the hosel 1214, and terminates at the upper edge 1216 thereof.

Figure 24:
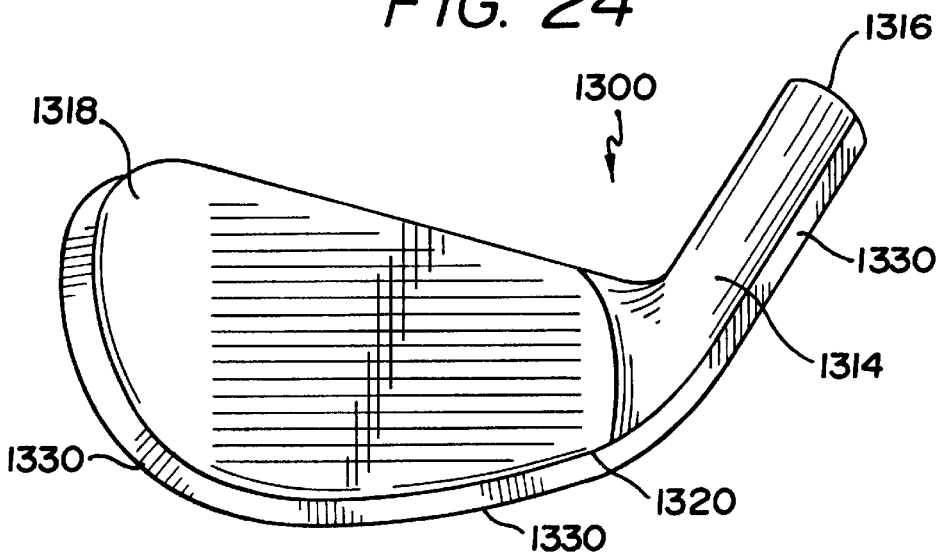
FIG. 24 is a front elevational view of fourteenth embodiment of a golf club head of the present invention.

FIG. 24 illustrates a fourteenth embodiment of a golf club 1300 in accordance with the present invention and includes a larger secondary outer peripheral weight 1330 which extends outwardly from the toe 1318 across the bottom 1320 of the club head 1300 to the hosel 1314 terminating at the upper edge 1316.

Figure 25:
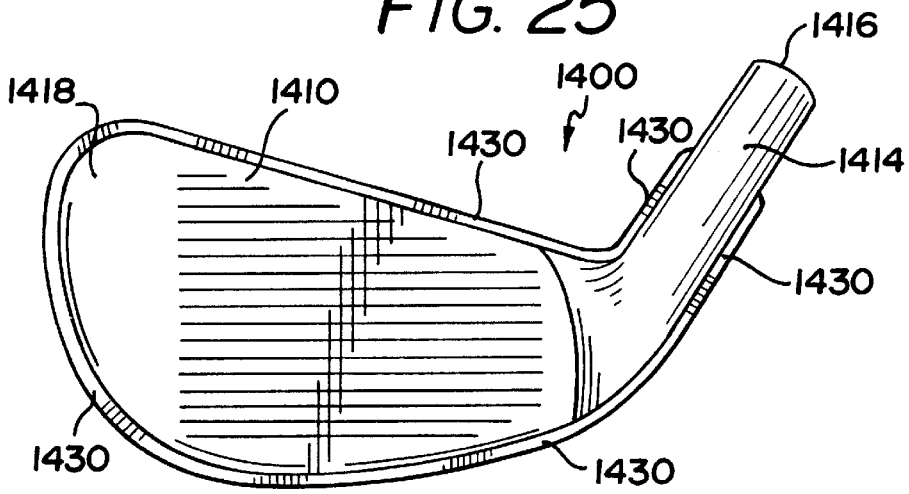
FIG. 25 is a front elevational view of fifteenth embodiment of a golf club head of the present invention.

FIG. 25 illustrates a fifteenth embodiment of a golf club 1400 in accordance with the present invention including a club head body 1410 and a hosel 1414 having a secondary outer peripheral weight member 1430 which extends around the entire primary perimeter 1424 of the club head 1400 partway on two opposite sides of the hosel 1414.

Figure 26:
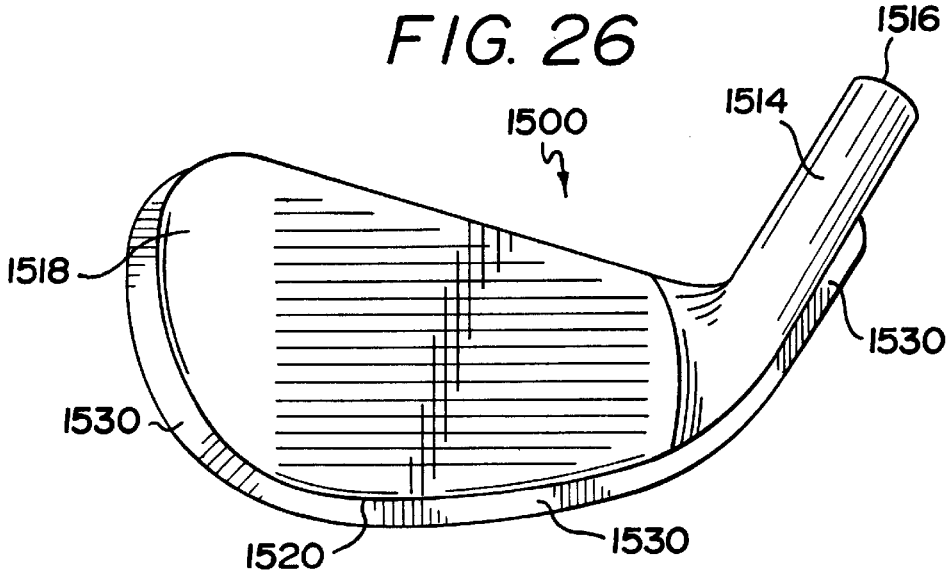
FIG. 26 is a front elevational view of sixteenth embodiment of a golf club head of the present invention.

FIG. 26 illustrates a sixteenth embodiment of a golf club 1500 in accordance with the present invention and includes a larger secondary outer peripheral weight 1530 which extends outwardly from the toe 1518 across the bottom 1520 of the club head 1500 to the hosel 1514 terminating partway up the length of the hosel 1514, below the top hosel edge 1516.

In all the embodiments disclosed in FIGS. 18–24, the secondary outer peripheral weight member extends at least onto a portion of the hosel, connecting the hosel with the club head body. This connection along the length of the hosel provides a much more rigid, unitized connection between the hosel and the club head body creating a solid connection which allows maximum transfer of power generated from the hands and arms of the player through the shaft and into the club head itself. It will be appreciated that the embodiments showing the secondary outer peripheral weight located on the top of the club head provide a more solid connection in this area whereas the embodiments showing the secondary outer peripheral weight on the bottom provide a more solid connection lower on the club head. Depending upon the playing characteristics of the individual golfer or the conditions encountered on a golf course, a club may be selected to optimize energy transfer depending where on the club head a ball is normally struck. For example, it may be more advantageous to have the secondary outer peripheral weight located toward the bottom of the club head and up onto the hosel for low lofted irons whereas it may be more advantageous to have the secondary outer peripheral weight located on the top of the club head for the higher lofted irons and wedges.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. An iron type golf club head comprising: a hosel, a club head body including a heel, a toe, a ball striking face having a face loft angle exceeding 10 degrees and a leading edge, a bottom sole, a top ridge surface, and rear surface having a trailing edge, a secondary outer weight member extending outwardly from peripheral surfaces of said club head, at least a part of said secondary outer weight member extending onto at least a portion of said hosel providing a unitized interconnection between said hosel and said club head body.

2. The golf club of claim 1 wherein said secondary outer weight member is defined as having a longitudinal, keel-shaped configuration.

3. The club head of claim 1 wherein said secondary outer weight member extends outwardly from said heel, from said bottom sole, and from said toe, from said top ridge surface and terminates on said hosel.

4. The club head of claim 1 wherein said secondary outer weight member terminates at an upper edge of said hosel.

5. The golf club head of claim 4, wherein said secondary outer weight member extends onto said hosel at two locations as viewed from both the heel and the front ball striking face and terminates at upper edges of the hosel.

6. The club head of claim 1 wherein said secondary outer weight member extends around the entire periphery of said club head body from said heel, across said bottom sole, said toe and said top ridge surface, joining said hosel at the interface of the hosel and the top ridge surface and further extends onto said hosel.

7. The club head of claim 1 wherein said secondary outer weight member terminates at an upper edge of said hosel.

8. The club head of claim 1 wherein said secondary outer weight member transitions onto at least a portion of said hosel.

9. The golf club head of claim 8, wherein said secondary outer weight member extends partway onto two locations of said hosel as viewed from both the heel and the front ball striking face.

10. The golf club head of claim 1, wherein said secondary outer weight member extends onto said hosel at a single location.

* * * * *